United States Patent [19]

Burton

[11] Patent Number: 4,940,212

[45] Date of Patent: Jul. 10, 1990

[54] COMPACT CARBONATED BEVERAGE MAKING SYSTEM

[76] Inventor: John W. Burton, 4 Woodland Dr., Pittsburgh, Pa. 15228

[21] Appl. No.: 462,458

[22] Filed: Jan. 9, 1990

Related U.S. Application Data

[63] Continuation-in-part of Ser. No. 296,502, Jan. 12, 1989.

[51] Int. Cl.[5] ..... B01F 3/04

[52] U.S. Cl. ..... 261/64.1; 141/382; 141/383; 141/5; 222/400.7; 222/399; 261/121.1; 261/DIG. 7

[58] Field of Search ..... 261/DIG. 7, 121.1, 64.1; 141/382, 383, 5; 222/400.7, 399

[56] References Cited

U.S. PATENT DOCUMENTS

| | | | |
|---|---|---|---|
| 755,600 | 3/1904 | Carlson . | |
| 1,055,648 | 3/1913 | Murphy | 261/DIG. 7 |
| 1,336,071 | 4/1920 | Dannelley . | |
| 1,336,720 | 4/1920 | Baulig | 261/DIG. 7 |
| 1,442,405 | 1/1923 | Hawthorne . | |
| 1,465,254 | 8/1923 | Davis | 141/382 |
| 1,830,480 | 11/1931 | Myers | 141/383 |
| 1,958,938 | 5/1934 | Bohandy | 261/DIG. 7 |
| 2,117,271 | 5/1938 | Bowman | 261/DIG. 7 |
| 2,160,501 | 5/1939 | Hedges et al. | 261/DIG. 7 |
| 2,498,596 | 2/1950 | Wallach | 141/383 |
| 2,906,624 | 9/1959 | Deren | 99/79 |
| 3,090,293 | 5/1963 | Plock et al. | 99/275 |
| 3,248,098 | 4/1966 | Cornelius | 261/DIG. 7 |
| 3,259,273 | 7/1966 | Kromer | 322/1 |
| 3,338,479 | 8/1967 | Marraffino | 222/399 |
| 3,361,152 | 1/1968 | Akers | 222/400.7 |
| 3,556,171 | 1/1971 | Gangwisch et al. | 141/3 |
| 3,599,833 | 8/1971 | Reichenberger | 222/23 |
| 3,749,141 | 7/1973 | Garretson | 141/5 |
| 4,265,376 | 5/1981 | Skidell | 261/DIG. 7 |
| 4,304,736 | 12/1981 | McMillin et al. | 261/35 |
| 4,304,741 | 12/1981 | Avison et al. | 261/121 |
| 4,342,710 | 8/1982 | Adolfsson et al. | 261/121 |
| 4,391,762 | 7/1983 | Child et al. | 261/121 |
| 4,399,081 | 8/1983 | Mabb | 261/121 |
| 4,531,656 | 7/1985 | Nitchman et al. | 222/131 |
| 4,548,828 | 10/1985 | Meyers | 261/121.1 |
| 4,629,589 | 12/1986 | Gupta et al. | 261/34.1 |
| 4,678,101 | 7/1987 | Nitchman et al. | 222/399 |

FOREIGN PATENT DOCUMENTS

| | | | |
|---|---|---|---|
| 470567 | 9/1914 | France | 261/DIG. 7 |
| 10308 | of 1890 | United Kingdom | 261/DIG. 7 |
| 2117657 | 10/1983 | United Kingdom | 261/DIG. 7 |

*Primary Examiner*—Tim Miles

*Attorney, Agent, or Firm*—Buchanan Ingersoll; Lynn J. Alstadt

[57] ABSTRACT

An apparatus for making carbonated beverages is disclosed which is comprised of a refillable bottle having a resealable passageway for filling, pressurizing and emptying the bottle and a carbon dioxide source connected to the bottle through a conduit. Preferably, a rounded interior bottom and projections are provided on the interior of the bottle. A diptube is also provided which preferably has radially extended vanes. The rounded bottom, interior projections and vanes will promote fogging when a bottle containing liquid and carbon dioxide is shaken. Consequently, carbonated water can be made easily by filling the bottle with water and carbon dioxide preferably at 60 p.s.i. and shaking the bottle, then repeating the process until the desired carbonation level is reached.

24 Claims, 2 Drawing Sheets

COMPACT CARBONATED BEVERAGE MAKING SYSTEM

Cross Reference to Related Application

This is a continuation-in-part of my U.S. Pat. application Ser. No. 296,502, filed Jan. 12, 1989, now pending.

FIELD OF INVENTION

The present invention relates to devices for making carbonated liquids.

DESCRIPTION OF THE PRIOR ART

Conventional methods for making carbonated water and other carbonated beverages involve the use of large tanks of carbon dioxide, refrigeration units and carbonators. Such systems are not practical for making carbonated beverages in the home.

Several small devices have been proposed for aerating beverages in glass bottles. U.S. Pat. No. 4,342,710 to Adolfsson et al. discloses an apparatus for aerating domestic use beverages such as flavored water comprising a gas cylinder containing carbon dioxide connected to a conduit which passes through a seal that covers the mouth of a glass bottle. The seal is pressed against the glass bottle and carbon dioxide is injected into the bottle. Similar devices are disclosed in U.S. Pat. No. 4,391,762 to Child et al. and U.S. Pat. No. 4,399,081 to Mabb. In all of these devices the bottle is opened after carbon dioxide has been injected into the liquid and then resealed. During this period carbon dioxide is lost from the liquid and its container. These devices also use high pressures which can break glass containers. Therefore, protective devices are needed to protect the user from a bursting glass bottle.

Consequently, there is a need for a compact device which can be used safely in the home for making carbonated beverages which retain their carbonation.

SUMMARY OF THE INVENTION

The present invention is directed to a compact home system for making carbonated beverages comprised of two basic elements, a carbon dioxide source and a bottle capable of being readily pressurized which is the subject of my U.S. Pat. application Ser. No. 069,845, filed July 6, 1987, now abandoned. The carbon dioxide source can be a standard carbon dioxide cylinder. I prefer to provide a regulator on the cylinder which limits the pressure to 60 p.s.i. in the line. Consequently, one can only fill the bottle to 60 p.s.i. At this pressure chilled water can be fully carbonated, and the bottle can be fully emptied and safely handled. I further prefer to provide a relief valve on the regulator as further protection. The relief valve is set to open at about 62 to 65 p.s.i. thereby preventing the bottle from being filled to too high a pressure if the regulator fails. I also prefer to provide a pressure gauge on the line tell the user the pressure being delivered to the bottle.

I prefer to provide a check valve in the line between the carbon dioxide cylinder and the bottle to prevent backflow from the bottle to the gas cylinder.

I further prefer to provide a bottle having a concave inner surface. This surface allows for greater mixing of the gas and liquid in the bottle.

I also prefer to provide a diptube in the bottle which extends from the opening. The bottle can be filled two thirds full of chilled water through the removable cap opening. Gas is then injected into the bottle through the diptube. I further prefer to provide fins on the diptube which assist in mixing the gas and liquid when the bottle is agitated.

DESCRIPTION OF THE PREFERRED EMBODIMENTS

Figure 1:
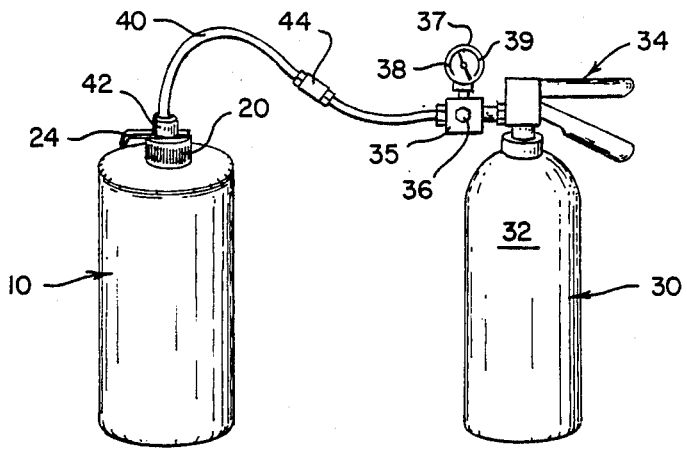
FIG. 1 is a prospective view showing a present preferred embodiment of my system.

As shown in FIG. 1, my system is comprised of a bottle 10 which contains the liquid to be carbonated and a carbon dioxide source 30. A gas supply line 40 is connected between bottle 10 and carbon dioxide cylinder 30. I prefer to provide a quick release coupling 42 on the end of supply line 40. This coupling 42 is engaged and held in place by lock 24 and attached to the cap 20 of bottle 10. I further prefer to provide a check valve 44 in line 40 to prevent backflow from bottle 10 to carbon dioxide cylinder regulator 35.

Carbon dioxide cylinder 30 is comprised of a standard pressurized gas cylinder 32 having a discharge valve which is opened by squeezing handle 34. A conventional screw type valve (not shown) could also be used. I prefer to provided a regulator 35 which limits the discharge from cylinder 32 to not more than 60 p.s.i. Then, bottle 10 can be pressurized to not more than 60 p.s.i. before automatic shut off by the pressure regulator. The regulator may be permanently attached to the gas cylinder 32 in a manner so that the user cannot remove the regulator from the off/on valve of the cylinder 32. Preferably, the off/on valve and regulator are made as one integral part. As an added safety feature, I prefer to provided a relief valve 36 which is preset to about 62 to 65 p.s.i. Should the regulator 35 malfunction, the relief valve 36 will prevent over pressurization of bottle 10. I also prefer to provide a pressure gauge 37 to tell the user how much pressure is in the line 40 and connected bottle 10. In addition to serving as a safety device against overpressurization, the gauge will enable the user to pressurize the bottle to pressures below the regulated pressure level of 60 p.s.i. I prefer to provide two colored zones 38 and 39 on the pressure gauge 37. Zone 38 runs from 0 to 65 p.s.i. and is colored green. This indicates that it is safe to fill the bottle to these pressure levels. Zone 39 runs from 65 p.s.i. to the upper limit of the gauge 37, normally 100 p.s.i. and is red. This indicates that it is dangerous to fill the bottle to pressures above 65 p.s.i.

To add carbon dioxide gas to the liquid in bottle 10 one connects line 40 to the bottle two-thirds full with chilled water using coupling 42. Then he squeezes handle 34 until a sufficient amount of gas has been injected into the bottle 10 to reach 60 p.s.i. or other desired pressure. At this point line 40 will also contain gas at the same pressure as bottle 10. When coupling 42 is disconnected from bottle 10, the bottle will self seal. Internal bottle pressure will decrease as carbon dioxide gas goes into solution. The bottle can be discharged with gas, shaken to hasten solution, and recharged until pressure remains near 60 p.s.i. indicating saturation and maximum carbonation. Unless a valve is provided in coupling 42, gas will escape from line 40 when the coupling 42 is released. This can cause no problems when the bottle is pressurized to 60 p.s.i. However, to prevent such a discharge one may provide a valve in coupling 42 which will open when the coupling is attached to bottle 10 and close when the coupling is released from the bottle. One could also provide a bleeder valve in line 40 to relieve the pressure before line 40 is disconnected.

Figure 2:
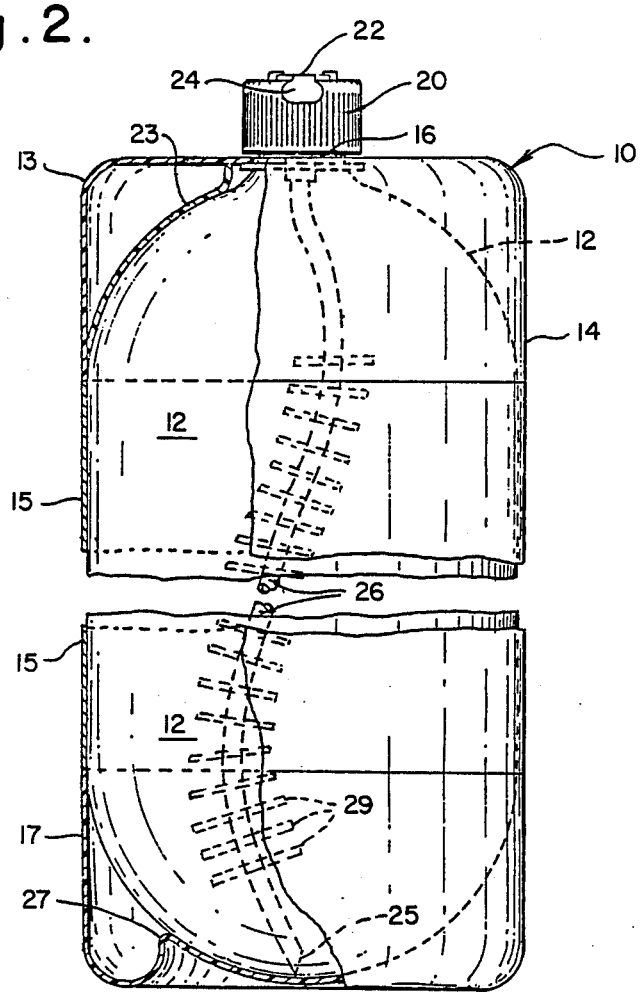
FIG. 2 is a prospective view partially in section of the present preferred bottle for use in my system.

Referring to FIG. 2, I provide a bottle 10, preferably having an inner shell 12, which is blow molded from plastic in the conventional manner. The shell 12 could also be made from non-corrosive materials such as aluminum, stainless steel or other material which meets FDA standards for food and beverage containers. Alternatively, the entire container could also be fabricated from such materials. Attached to the inner shell is an outer shell 14 which I prefer to make in three pieces. First there is a reinforcing wrap 15 made of a strong plastic or metal, such as stainless steel or aluminum, which is wrapped about the center of the inner shell 12. This reinforcement is applied by cementing the layer to the inner shell. Alternatively, it may be placed in a blow mold when the inner shell is made and attached during molding. I also provide an upper end portion 13 of the outer shell which is attached to the upper portion of the inner shell 12 by cementing or during molding. Finally, there is a lower portion of the outer shell 17 which is similarly made of metal or hard plastic to provide reinforcement. This too can be cemented to the inner shell 12 or made a portion of the inner shell during molding. Because the bottle is preferably designed to withstand both vacuum or negative pressure as well as above atmospheric pressures, I may design the top portion 13 so that it has an inner surface 23 which conforms and attaches to the inner shell 12 as shown in FIG. 1. Similarly, an inner surface 27 is provided on the bottom portion 17 and is attached to inner shell 12 by cementing or during molding. The inner surface 27 of the bottom portion conforms to and covers a substantial part of the bottom of the inner shell. I prefer to provide a conventional mouth 16 having outer threads 18 (not shown) for receipt of a cap 20. The removable cap 20 enables the user to easily fill the bottle with cold liquids and permits easy cleaning and sterilization of the bottle and cap-diptube assembly. Consequently, my system can meet all FDA requirements for cleaning and sterilization. Alternatively, one could easily mold cap 20 to the mouth of the inner shell if desired. Within the cap I provide a valve 22 having an optional outer lock 24. A sealing ring (not shown) may be placed in the cap to engage and seal the mouth of the bottle. I provide a flexible diptube 26 which extends from valve 22. The diptube preferably contains a plurality of readily extending projections such as vanes 29 which are pivotally attached to the diptube 26. Such an attachment permits the vanes to be folded to a position parallel to the diptube, when the tube is inserted into the bottle. Then they unfold to an operable position shown in FIG. 2. Alternate diptube attachments could be multiple conical funnels or neck support washers mounted on the diptube. The contents of the bottle should be under sufficient pressure from gas in the ⅓ void above the liquid to force those contents through the diptube and valve 22 when the valve is open. Consequently, no propellant need be added to my refillable bottle after filling to discharge the contents. I prefer to terminate the diptube at an angle 25. Also, tube 26 does not quite reach the bottom of the inner shell so that when the bottle is tipped on its side it will lay against the side. Consequently, I am able to dispense all of the contents of my container when it is either in the vertical position, or in a horizontal position. The diptube 26 should be made of a flexible material such as rubber or plastic. Vanes 29 may be plastic, aluminum or stainless steel.

Figure 3:
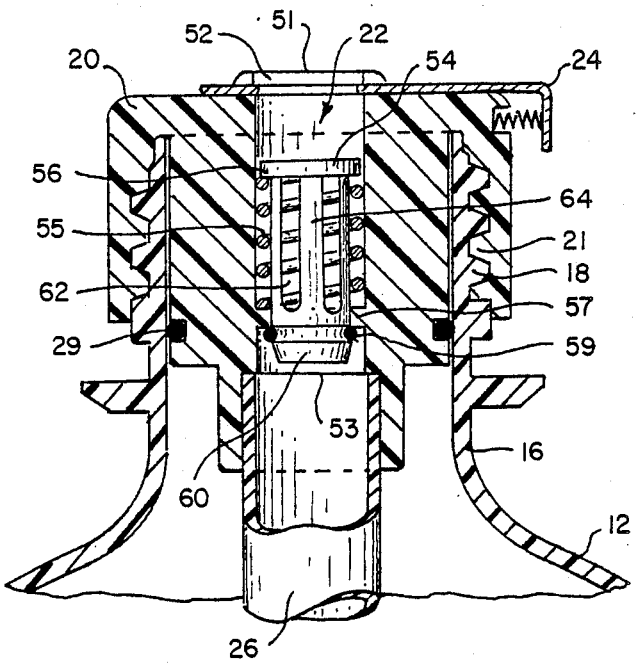
FIG. 3 is a sectional view of the cap and valve portion of the bottle of FIG. 2.

In FIG. 3, I have shown a present preferred embodiment of the cap and valve arrangement. The cap 20, which can be made of metal or plastic, is preferably molded of plastic to have interior threads 21 which mate with threads 18 on the mouth of the bottle. I also prefer to provide an O-ring seal 29 which seals any gap between the cap and the mouth of the bottle. Within the cap there is a valve 22. This valve consists of a generally cylindrical outer housing 52 with openings 51 and 53. Within housing 52 is a basket 54 which rests on springs 55. This spring is positioned between upper rim 56 of basket 54 and shoulder 57. The basket is closed at its bottom 60, but has a plurality of slots 62 in the side wall 68. The valve is operated by inserting a coupling 42 (FIG. 1) which pushes basket 54 into the bottle 10 or diptube 26. When the coupling is removed the basket returns to its original position shown in FIG. 3. An exterior seal 5a is provided on the lower portion of the basket 54. Diptube 26 is attached to the cap in any conventional manner such as provide a force fit as shown in FIG. 3. If bottles are being used for several different types of fluids, one may make the cap 20, the valve 22 or both in different size. Only one cap is used for a given fluid to prevent or discourage the user from filling a bottle with an incorrect or inappropriate fluid. One may also incorporate a fluid pressure relief valve in the cap.

I have found that liquids, particularly water, absorb the most carbon dioxide when at a temperature of about 34° F. I prefer to fill the bottle 10 to about two thirds full of water. Then, I add carbon dioxide to about 60 p.s.i. Next, I vigorously shake the bottle while holding it at an angle of approximately 45° from vertical. This agitation causes the liquid and gas to mix. Additionally, the curved bottom and vanes 29 on diptube 26 create a fog when the bottle is shaken. The fog condition is optimal for absorption of carbon dioxide by the liquid. The combination of two thirds liquid and one third gas by volume in the bottle also appears to be the best proportion of liquid to gas at 60 p.s.i. for maximum carbonation.

After the water has been carbonated it can be removed from the bottle by attaching a valve or tube or carbonation retention diffuser to valve 22 in cap 20. Because valve 22 reseals the bottle whenever fluid is not being removed from or injected into the bottle, the liquid in the bottle 10 will retain its carbonation, and will never go flat.

It should be apparent that both the bottle 10 and carbon dioxide cylinder 30 are reuseable. Indeed, when cylinder 30 is filled to an initial liquid charge of 1000 p.s.i. I can fill a two or three liter bottle two thirds full of liquid and one third full of gas at 60 p.s.i. repeatedly for several months usage.

My system provides a safe and economical method for creating several liters of carbonated beverages in the home. It enables the user to create any desired level of carbonation. Moreover, my bottle is always sealed when fluid is not flowing out of or into it. Therefore, the liquid retains its carbonation until the bottle contents are used. The system is also quite simple and requires no peripheral housings or fixtures to hold the bottle and carbon dioxide source.

While I have shown several presently preferred embodiments of the invention, it is to be distinctly understood that the invention is not limited thereto, but may be variously practiced within the scope of the following claims.

I claim:

1. An apparatus for making carbonated beverages comprising:

(a) a reuseable bottle comprised of a top, a base and at least one wall attached between the top and the base which together define an enclosed space and at least one valve attached to said top having a single resealable passageway for repeated filling, pressurizing and emptying the bottle, said bottle being sized and constructed so as to be capable of retaining fluid at pressures above atmospheric pressure, said valve being capable of being opened by one of a filler probe and a discharge nozzle which engages the valve and pushes toward the enclosed space and said valve being closed when the valve is not pushed toward the enclosed space and when open said valve will permit a liquid to easily flow through said valve;

(b) a carbon dioxide source having a gas valve through which carbon dioxide may be dispensed upon actuation of the valve; and (c) conduit connected between the valve of the carbon dioxide source and the valve of the bottle.

2. The apparatus of claim 1 also comprising at least one valve within the conduit.

3. The apparatus of claim 1 also comprising a check valve connected to the conduit in a manner to prevent flow from the bottle to the carbon dioxide source.

4. The apparatus of claim 1 also comprising a diptube with the bottle, connected to and extending from the bottle valve.

5. The apparatus of claim 4 also comprising at least one projection attached to and extending from the diptube.

6. The apparatus of claim 5 wherein the projections are made of a noncorrosive material.

7. The apparatus of claim 6 wherein the projections are made from one of stainless steel, aluminum and plastic.

8. The apparatus of claim 1 also comprising a regulator attached to the conduit in a manner to permit regulation of carbon dioxide flow from the carbon dioxide source to the bottle.

9. The apparatus of claim 8 wherein the regulator is sized to permit reduction of carbon dioxide pressure from about 1,000 p.s.i. to about 60 p.s.i.

10. The apparatus of claim 1 wherein the carbon dioxide source has an off/on valve and also comprising a regulator permanently attached to the off/on valve of the carbon dioxide source in a manner so that a user cannot remove the regulator from the off/on valve.

11. The apparatus of claim 10 wherein the off/on valve and regulator are made as one integral part.

12. The apparatus of claim 1 also comprising a quick connect sealed fitting connected to the conduit at one end and sized to fit into and open the valve of the bottle.

13. The apparatus of claim 1 wherein the bottle is filled to two thirds its volume with liquid and one third of its volume with gas.

14. The apparatus of claim 13 wherein the gas is at about 60 p.s.i.

15. The apparatus of claim 13 wherein the liquid is about 34° F. to 36° F.

16. The apparatus of claim 1 wherein the top, base and walls of the bottle are composed of a noncorrosive material.

17. The apparatus of claim 16 wherein the noncorrosive material is selected from the group consisting of plastic, stainless steel and aluminum.

18. The apparatus of claim 1 wherein the walls, top and base of the bottle are made from plastic also consisting of a rigid metal wrap bonded to cover all vertical surfaces of the bottle to form a bimaterial rigid wall, said wrap being sized and positioned to provide increased strength to the container.

19. The apparatus of claim 1 wherein the carbon dioxide source is a conventional gas cylinder.

20. The apparatus of claim 1 wherein the carbon dioxide source is a gas cylinder and the gas valve is a pistol-grip type activated valve.

21. The apparatus of claim 1 also comprising a relief valve attached to one of the conduit and the carbon dioxide source.

22. The apparatus of claim 1 also comprising a pressure gauge attached to the conduit.

23. The apparatus of claim 22 wherein the pressure gauge contains colored zone markings indicating safe pressure levels and dangerous pressure levels.

24. The apparatus of claim 1 wherein the top of the bottle contains an opening for easy cleaning and sterilization of the bottle to meet the FDA requirements for food and beverage use and also comprising a removable resealable cap attached to the top and covering the opening.

* * * * *